United States Patent [19]

Shur

[11] Patent Number: 5,038,428

[45] Date of Patent: Aug. 13, 1991

[54] HAMMOCK HAVING PILLOW AND INCISION

[76] Inventor: Paul Shur, 1701 Main St., Suite 142, Dunedin, Fla. 34698

[21] Appl. No.: 632,527

[22] Filed: Dec. 24, 1990

[51] Int. Cl.[5] ..... A45F 3/22

[52] U.S. Cl. ..... 5/122; D6/387

[58] Field of Search ..... 5/120–123; 128/845; D6/386, 387

[56] References Cited

U.S. PATENT DOCUMENTS

| | | | |
|---|---|---|---|
| 203,795 | 5/1978 | Sutton | 5/122 |
| 4,691,394 | 9/1987 | Woo | 5/120 |

FOREIGN PATENT DOCUMENTS

| | | | |
|---|---|---|---|
| 1156226 | 5/1958 | France | 5/120 |
| 61555 | 9/1926 | U.S.S.R. | 5/122 |

*Primary Examiner*—Alexander Grosz
*Attorney, Agent, or Firm*—Stanley M. Miller

[57] ABSTRACT

A pillow and a slot are added to an otherwise conventional hammock. The pillow is mounted atop the hammock adjacent a longitudinal edge, mid-length of the hammock so that the transverse axis of symmetry of hammock bisects the pillow. The slot has a predetermined longitudinal extent and is also positioned mid-length of the hammock and is bisected by the transverse axis of symmetry. The pillow and slot are on opposite sides of the longitudinal axis of symmetry of the hammock. A first individual standing in the slot may massage a second recumbent individual whose head is supported by the pillow and whose feet may extend through the slot and rest atop the floor below the hammock or may rest atop the hammock on opposite sides of the first individual.

3 Claims, 1 Drawing Sheet

HAMMOCK HAVING PILLOW AND INCISION

BACKGROUND OF THE INVENTION

1. Field of the Invention

This invention relates, generally, to improvements in hammock design. More particularly, it relates to a hammock having a pillow and a slot formed therein that enhances the utility of the hammock.

2. Description of the Prior Art

A hammock is a flexible, bed-like device that is suspended between two support pillars. Trees are believed to have served as the support pillars for the earliest hammocks, but in modern times metallic and plastic frames have been designed that support hammocks at their opposite ends. As a result, hammocks can now be used indoors, but they are seldom thought of as indoor furniture.

Hammocks are always made of a flexible material, because the original purpose of the hammock was to provide an easily constructed, yet comfortable bed. Both open weave and closed weave designs have utility, the former being associated with traditional Mexican Yucatan hand-made varieties and the latter being associated with factory-made types. Typically, the designs include a rigid cross bar at the opposite ends of the bodysupporting part of the hammock and plural radiating strands that extend from a support post to the cross bar. The function of the cross bar is to maintain the width or transverse extent of the hammock when a weight is deposited atop it. There are many designs, however, that do not rely upon a rigid cross bar to hold the hammock open.

The art of hammock design has been stagnant for centuries, because the conventional wisdom has been and remains that the hammock is a primitive furniture item that is so elementary in structure that any improvements thereto would result in an item that would not even be a hammock. Thus, countless artisans have studied the hammock with an eye toward improving it, and all have heretofore failed. The addition of the above-mentioned rigid cross bar is believed to be the only significant improvement to hammocks since their invention by a weary but innovative artisan whose name was not recorded by his unimpressed contemporaries.

SUMMARY OF THE INVENTION

A pillow having its longitudinal axis parallel to the longitudinal axis of a hammock and a longitudinally extending slot that is transversely spaced from that pillow are both positioned about mid-length of an otherwise conventional hammock and collectively provide the world's first indoor hammock that enables its users to enjoy hammocks in a way heretofore unknown.

The pillow is positioned near a preselected edge of the hammock so that a first individual can rest his or her head thereon when lying on the hammock in a transverse position. The transverse position is orthogonal to the customary longitudinal position.

The reclining individual's buttocks will be positioned adjacent the slot when that individual's head is resting atop the pillow. Accordingly, that individual can bend his or her knees and place his or feet on the ground or floor below the hammock by inserting his or her legs through the slot. This enables the individual to rock the hammock transversely relative to its longitudinal axis. Such foot placement and rocking motion thereby made possible are unachieavble with conventional hammocks lacking the slot. Just as importantly, conventional hammocks lack the pillow positioned mid-length of the novel hammock design.

If a second individual desires to massage or otherwise contact the reclining individual, he or she may stand in the slot facing the pillow, and upon doing so will discover that massage and other forms of contact with the reclining individual are facilitated by the provision of the slot. When such contact is taking place, the reclining individual may place his or her feet on the floor through the slot as aforesaid, or may return said feet to the hammock, positioning said feet on opposite sides of the individual standing in the slot so as not to interfere with that individual's motions.

It is therefore understood that a primary object of this invention is to awaken the moribund hammock industry by providing the world's first hammock having a pillow positioned mid-length thereof, and by providing the world's first hammock that includes a slot that provides heretofore unknown uses for a hammock.

These and other objects, advantages and features of the invention will become apparent as this description proceeds.

The invention accordingly comprises the combination of elements, features of construction and arrangement of parts that will be set forth hereinafter, and the scope of the invention will be set forth in the claims.

BRIEF DESCRIPTION OF THE DRAWINGS

For a fuller and more complete understanding of the invention, reference should be made to the following detailed description, taken in connection with the drawings wherein.

DETAILED DESCRIPTION OF THE PREFERRED EMBODIMENT

Figure 1:
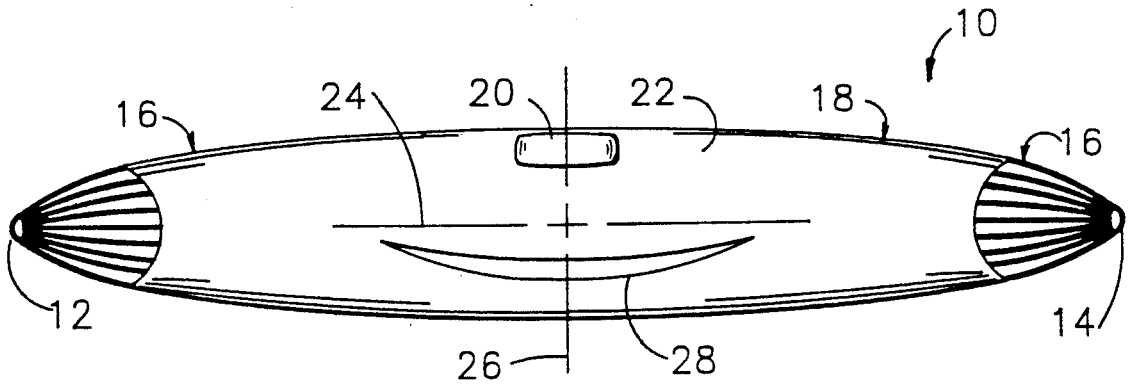
FIG. 1 is a top plan view of an exemplary embodiment of the invention when the hammock is in a stretched configuration.
Figure 2:
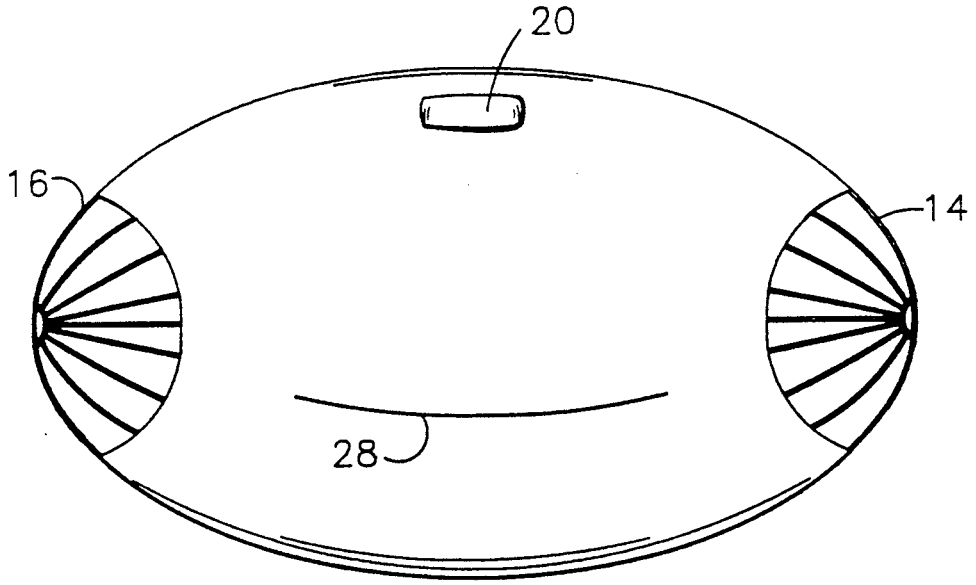
FIG. 2 is a top plan view thereof when the hammock is in repose.

Referring now to FIG. 1, it will there be seen that an illustrative embodiment of the invention is denoted as a whole by the reference numeral 10.

Hammock 10 has opposite ends 12 and 14 that are secured to suitable upstanding support posts, not shown. Plural strands, collectively denoted 16, radiate therefrom and terminate in an arcuate pattern where said strands meet the main body 18 of the hammock. Main body 18 is shown of canvas construction, but open weave constructions are also within the scope of this invention. Rigid cross bars, not shown, may also be provided where the strands meet the main body 18 of hammock 10.

The above-described construction is conventional; that which follows is not.

Pillow 20 has a longitudinal axis of symmetry 22 that is parallel to the longitudinal axis of symmetry 24 of hammock 10. This unique placement of a pillow enables an individual to lie comfortably atop hammock 10 in a position transverse to the longitudinal axis of the hammock Note that pillow 20 is remote from said longitudinal axis of symmetry 24, i.e., it is positioned adjacent a predetermined longitudinal edge of the hammock 10. Note also that said pillow is bifurcated by the transverse axis of symmetry 26 of hammock 10.

Slot 28 also extends generally parallel to longitudinal axis 24, but is positioned in transversely spaced relation to pillow 20 on the opposite side of axis 24 as shown. The longitudinal extent of slot 28 is not critical, but in a hammock having a ninety inch long main body 18, the preferred longitudinal extent of slot 28 is forty inches.

Like pillow 20, slot 28 is also bifurcated by the transverse axis 26 of hammock 10. It should also be noted that the slot is located between longitudinal axis 24 and the periphery of hammock 10.

It should be apparent that an individual recumbent upon hammock 10 with his or her head supported by pillow 20 may rest his or her feet upon the floor below the hammock by inserting them through slot 28, or may rest said feet atop the hammock. One preferred position of the recumbent individual when the latter position is selected includes a first foot positioned toward one end of slot 28 and the other foot disposed at the opposite end thereof so that said feet are longitudinally spaced apart from one another.

When said recumbent individual is disposed in the latter position, a second individual may stand in the space provided by the slot, facing the recumbent individual, to advantageous effect. For example, the upright individual may perform a massage or otherwise interact with the recumbent individual, producing effects heretofore unknown.

This invention is clearly new and useful. Moreover, it was not obvious to those of ordinary skill in the art at the time it was made, in view of the prior art, considered as a whole.

It will thus be seen that the objects set forth above are efficiently attained, and that the claims that follow are intended to cover all generic and specific embodiments thereof and all embodiments that might be said, as a matter of language, to fall therebetween.

Now that the invention has been described,

What is claimed is:

1. An improvement in hammocks, comprising:

a pillow positioned adjacent a longitudinal edge of said hammock, about mid-length thereof;

a slot means formed in said hammock, about mid-length thereof;

wherein said pillow and said slot means are positioned on opposite sides of a longitudinal axis of symmetry of said hammock;

wherein said pillow and said slot means are elongated and wherein a longitudinal axis of symmetry of said pillow is parallel to a longitudinal axis of symmetry of said slot means, and wherein the longitudinal axis of symmetry of said hammock is parallel to the respective longitudinal axis of symmetry of said pillow and said slot means; and wherein said slot means has a predetermined longitudinal extent that is greater than a predetermined longitudinal extent of said pillow.

2. The hammock of claim 1, wherein said hammock has a transverse axis of symmetry and wherein said transverse axis of symmetry bisects said pillow and said slot means.

3. The hammock of claim 2, wherein said slot means has a predetermined size sufficient to accommodate an individual standing therein.

* * * * *